US008763190B2

(12) United States Patent
Ross

(10) Patent No.: US 8,763,190 B2
(45) Date of Patent: Jul. 1, 2014

(54) PORTABLE HAIR/LINT ROLLER

(75) Inventor: Tylor Christian Ross, Edwardsburg, MI (US)

(73) Assignee: Telebrands Corp., Fairfield, NJ (US)

( * ) Notice: Subject to any disclaimer, the term of this patent is extended or adjusted under 35 U.S.C. 154(b) by 0 days.

(21) Appl. No.: 13/163,275

(22) Filed: Jun. 17, 2011

(65) Prior Publication Data

US 2012/0036661 A1 Feb. 16, 2012

Related U.S. Application Data

(60) Provisional application No. 61/372,692, filed on Aug. 11, 2010.

(51) Int. Cl.

| | |
|---|---|
| ***A47L 25/00*** | (2006.01) |
| ***A46B 15/00*** | (2006.01) |
| ***A47L 13/00*** | (2006.01) |
| ***A47L 13/12*** | (2006.01) |

(52) U.S. Cl.

CPC ..... *A47L 25/005* (2013.01); *A46B 2200/3033* (2013.01); *A46B 2200/302* (2013.01); *A47L 13/00* (2013.01); *A47L 13/12* (2013.01); *A46B 15/0055* (2013.01)

USPC ..... 15/104.002; 15/104.001; 15/105

(58) Field of Classification Search

USPC ..... 15/104.002, 104.001, 105, 106, 114, 15/159.1, 160, 188

IPC ..... A47L 25/00

See application file for complete search history.

(56) References Cited

U.S. PATENT DOCUMENTS

| | | | |
|---|---|---|---|
| 702,998 | A | 6/1902 | Randolph |
| 894,011 | A | 7/1908 | Kampfe |
| 1,827,003 | A | 10/1931 | Gailhofer |
| 2,065,584 | A | 12/1936 | Hempel |
| 2,534,086 | A | 12/1950 | Vosbikian |
| D165,753 | S | 1/1952 | Herron |
| 2,715,742 | A | 8/1955 | Coles |

(Continued)

FOREIGN PATENT DOCUMENTS

| | | | |
|---|---|---|---|
| CN | 201182695 | Y | 1/2009 |
| CN | 202341956 | U | 7/2012 |

(Continued)

OTHER PUBLICATIONS

Office Action mailed by the USPTO on May 21, 2012 in related U.S. Appl. No. 13/413,370 (Inventor: Tylor Christian Ross).

(Continued)

*Primary Examiner* — Monica Carter
*Assistant Examiner* — Stephanie Berry
(74) *Attorney, Agent, or Firm* — Jeffrey L. Snow; Cooper & Dunham LLP

(57) ABSTRACT

A combination sticky roller and brush for dislodging and collecting debris from a plurality of different types of surfaces. The present invention utilizes a rubber brush to dislodge debris such as hairs, dusts, or dirt from a surface. The device includes a compartment with a cover lid that conceals a sticky roller. Once the debris is uprooted from a surface, the user is able to roll the sticky roller over the surface to pick up and retain the debris. The present invention can be used on fabrics or other textiles surfaces and is convenient for use anywhere due to its travel sized and unique configuration.

5 Claims, 8 Drawing Sheets

(56) References Cited

U.S. PATENT DOCUMENTS

| | | | |
|---|---|---|---|
| 2,895,152 | A | 7/1959 | Vosbikian |
| 2,935,754 | A | 5/1960 | Abdo |
| 3,148,398 | A | 9/1964 | Thomas, Jr. |
| 3,158,887 | A | 12/1964 | Kanbar |
| D207,048 | S | 2/1967 | Pekar |
| 3,363,276 | A | 1/1968 | Thomas, Jr. |
| 3,398,418 | A | 8/1968 | Hans |
| 3,460,296 | A | 8/1969 | Dittmar |
| 3,538,533 | A | 11/1970 | Woods |
| D222,900 | S | 2/1972 | Derian |
| 3,686,699 | A | 8/1972 | Knestele |
| 3,742,547 | A | 7/1973 | Sohmer |
| 3,744,082 | A | 7/1973 | Marshall |
| 3,749,491 | A | 7/1973 | Maxfield |
| 3,830,118 | A | 8/1974 | Holub, III |
| 3,838,474 | A | 10/1974 | Erickson |
| 3,906,578 | A | 9/1975 | Huber |
| 4,381,157 | A | 4/1983 | Brown |
| D282,604 | S | 2/1986 | Whitaker |
| 4,703,538 | A | 11/1987 | Silverstone |
| 4,802,782 | A | 2/1989 | Scalf |
| 4,979,257 | A | 12/1990 | Heneveld |
| D313,509 | S | 1/1991 | Ueda |
| D324,779 | S | 3/1992 | Ueda |
| 5,153,254 | A | 10/1992 | Chen |
| 5,162,858 | A | 11/1992 | Shoji |
| D336,784 | S | 6/1993 | Yen |
| 5,333,341 | A | 8/1994 | Heneveld |
| D358,487 | S | 5/1995 | Kneesch et al. |
| 5,533,223 | A | 7/1996 | Ho |
| D382,408 | S | 8/1997 | Thielen |
| 5,927,057 | A | 7/1999 | Hueber |
| D485,075 | S | 1/2004 | Hutchinson |
| 6,671,921 | B1 | 1/2004 | Hickman |
| 7,020,926 | B2 | 4/2006 | McKay |
| 7,065,822 | B1 | 6/2006 | Vandenburg |
| 7,111,351 | B1 | 9/2006 | DeRoma |
| 7,334,285 | B1 | 2/2008 | Morad et al. |
| 7,377,001 | B2 | 5/2008 | McKay |
| D572,868 | S | 7/2008 | McKay |
| 7,621,234 | B2 | 11/2009 | Roy |
| 7,624,469 | B2 | 12/2009 | Specht et al. |
| 7,640,893 | B2 | 1/2010 | Woods |
| D622,467 | S | 8/2010 | Martin |
| 7,856,690 | B2 | 12/2010 | Tuman et al. |
| D634,126 | S * | 3/2011 | Viola ..... D4/116 |
| 2004/0052570 | A1 | 3/2004 | McKay |
| 2005/0183223 | A1 | 8/2005 | Cheng |
| 2007/0192979 | A1 | 8/2007 | Knopow et al. |
| 2009/0226657 | A1 | 9/2009 | Thiele |
| 2012/0036660 | A1 | 2/2012 | Ross |
| 2012/0159726 | A1 | 6/2012 | Ross |

FOREIGN PATENT DOCUMENTS

| | | |
|---|---|---|
| JP | 8143834 | 6/1996 |
| JP | 11019024 | 1/1999 |
| JP | 11299722 | 11/1999 |
| JP | 2008-279097 A | 11/2008 |

OTHER PUBLICATIONS

Office Action mailed by the USPTO on Jun. 13, 2012 in commonly owned U.S. Appl. No. 13/396,214 (Inventor: Tylor Christian Ross).
Office Action mailed by the USPTO on Jun. 13, 2012 in commonly owned U.S. Appl. No. 13/008,206 (Inventor: Tylor Christian Ross).
Issue Notification mailed by the USPTO Jul. 23, 2013 in commonly owned U.S. Appl. No. 13/396,214, now U.S. Patent 8,490,237.
Issue Notification mailed by the USPTO Jul. 23, 2013 in commonly owned U.S. Appl. No. 13/008,206, now U.S. Patent 8,490,236.
Office Action mailed by the USPTO Nov. 19, 2013 in related U.S. Appl. No. 13/413,370.

* cited by examiner

PORTABLE HAIR/LINT ROLLER

The current application is a nonprovisional application and claims a priority to the U.S. provisional patent application Ser. No. 61/372,692 filed on Aug. 11, 2010 and the U.S. nonprovisional utility patent application Ser. No. 13/008,206 filed on Jan. 18, 2011.

FIELD OF THE INVENTION

The present invention relates generally to a combination sticky roller and brush. More specifically, the present invention is used for collecting debris such as hair and lint from surfaces.

BACKGROUND OF THE INVENTION

Traditionally, to remove lint, hairs or debris off of clothing or any other fabric products requires the use of a lint remover that provides a simple sticky roller. However, often times when using the traditional lint remover, the user is required to make many passes over the clothing to completely pick up all the hair, lint, or any other debris stuck on the clothes. In other cases, some hairs or lint are securely intertwined with the fibers of a user's clothing and require more than the simple roll over contact to be pulled off the clothing. To overcome such a problem, some lint removers make use of brushes that are very invasive and can damage the fabric weaving of the clothing. Such invasive brushes can lead to damage such the balling up of the fibers on the clothing. To overcome such a problem, the present invention introduces a portable hair and lint remover that is able to remove persistent lint or hair from clothing or any other fabric surfaces. The present invention is also conveniently sized for travel and can be used as a detail brush for cleaning the tight corners of the interior in an automobile.

DETAIL DESCRIPTIONS OF THE INVENTION

Figure 1:
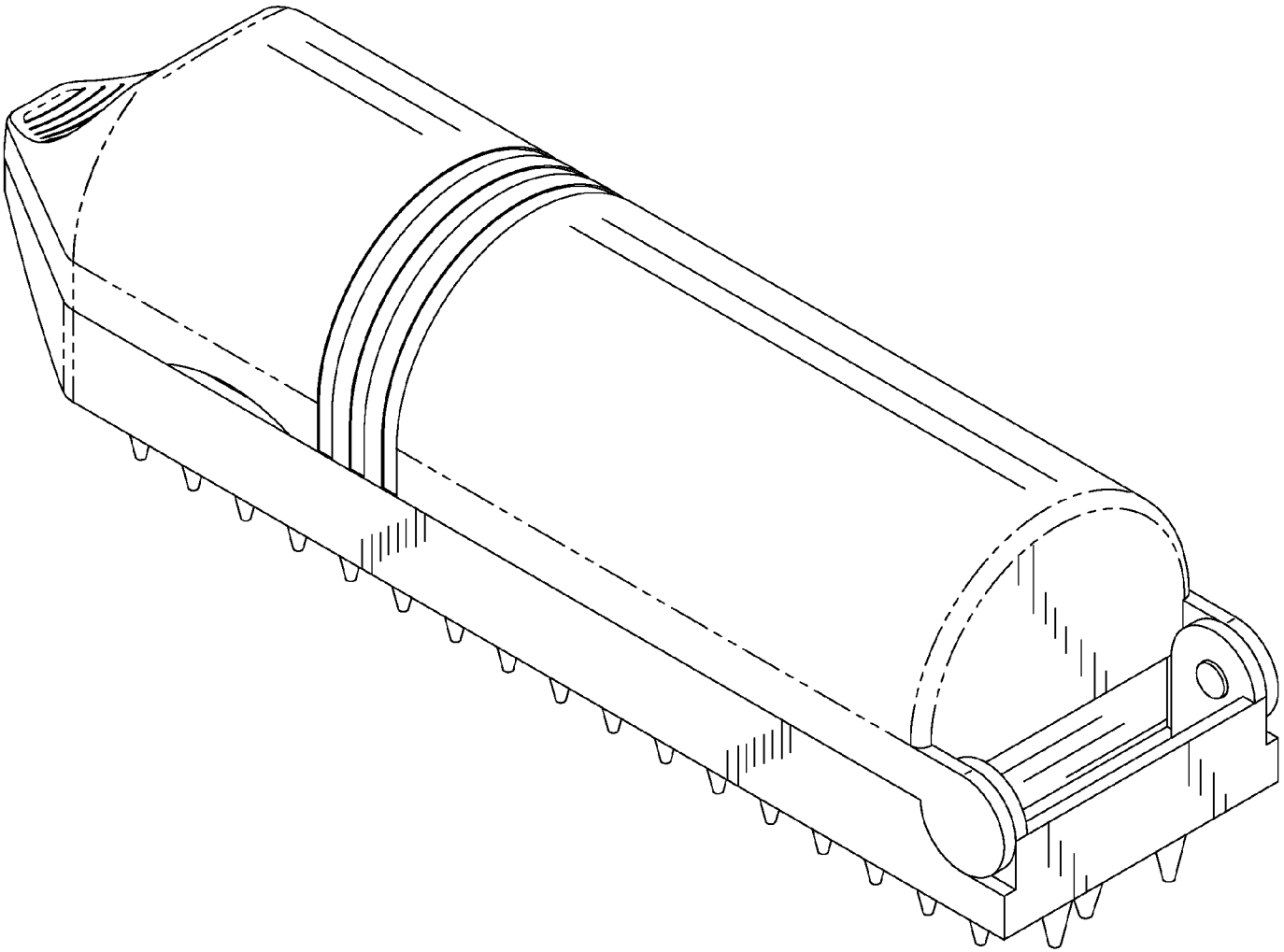
FIG. 1 is a perspective view of the present invention in a closed position enclosing the roller.
Figure 2:
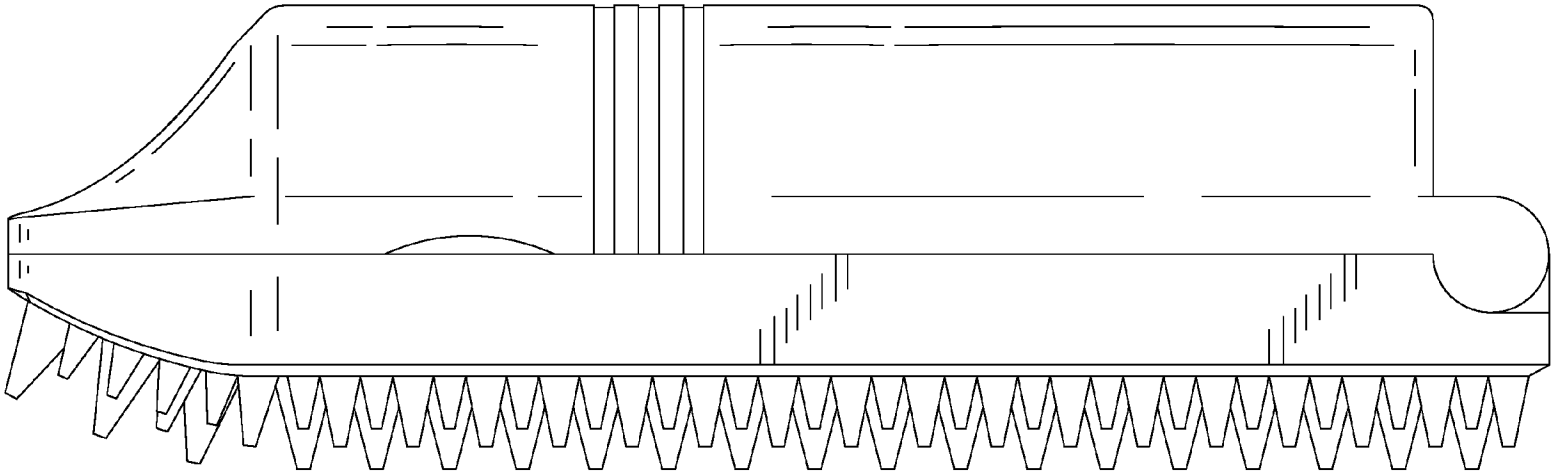
FIG. 2 is a right side elevational view of the present invention in a closed position.
Figure 3:
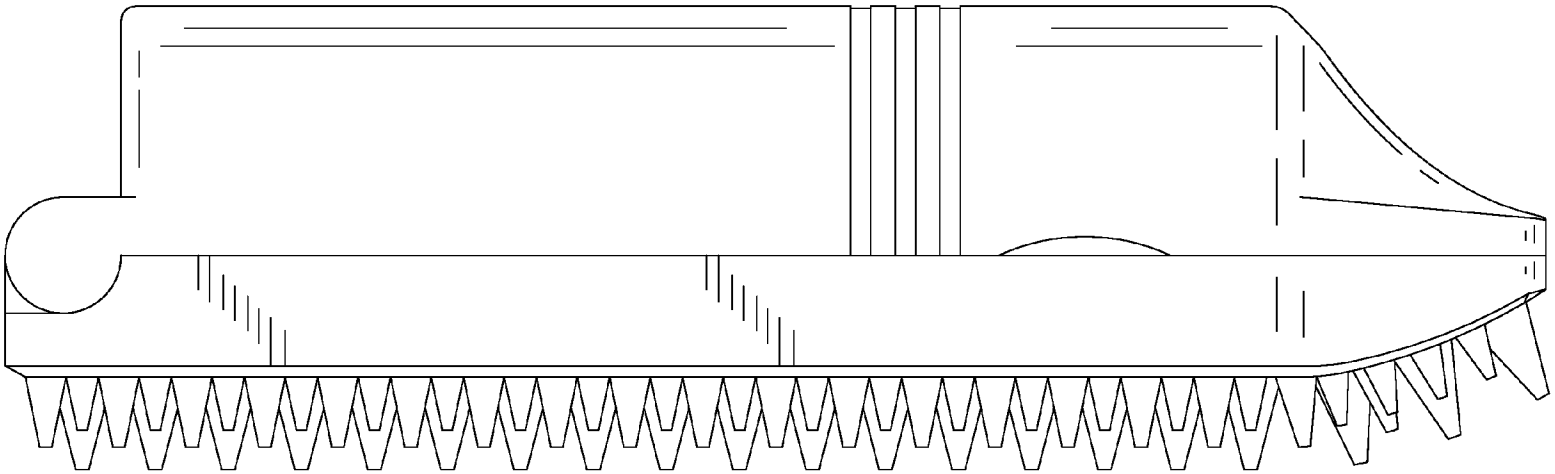
FIG. 3 is a left side elevational view of the present invention in a closed position.
Figure 5:
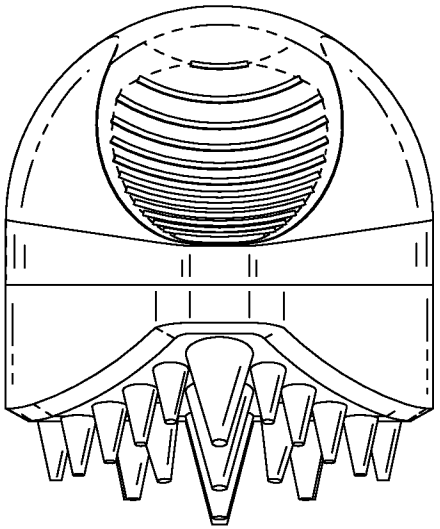
FIG. 5 is a front elevational view of the present invention in a closed position.
Figure 4:
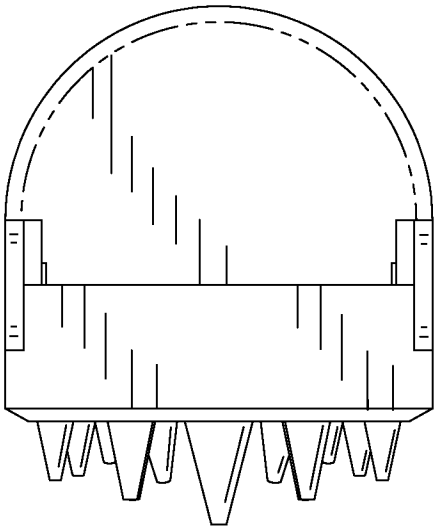
FIG. 4 is a rear elevational view of the present invention in a closed position.
Figure 6:
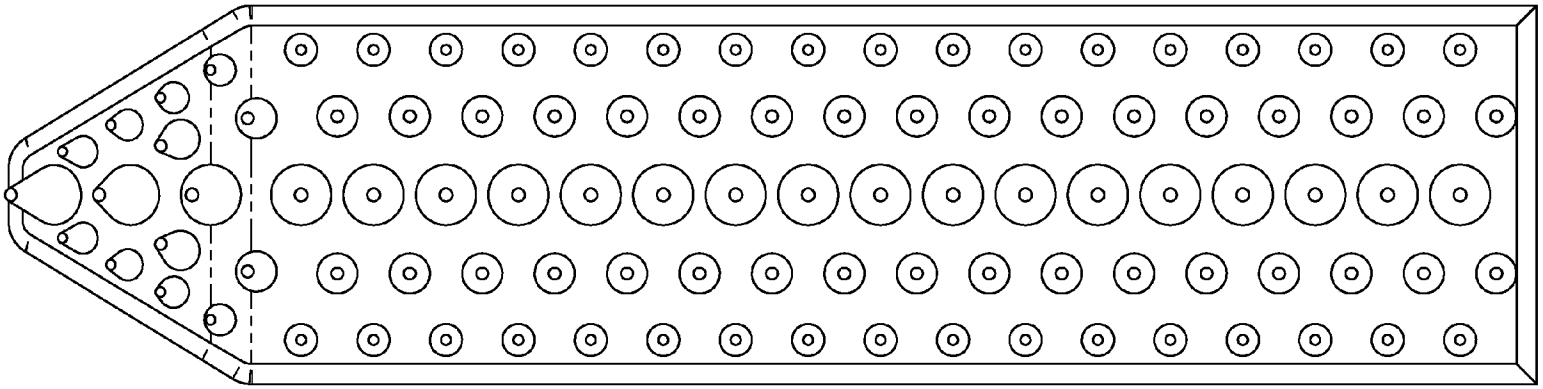
FIG. 6 is a bottom plan view of the present invention in a closed position.
Figure 7:
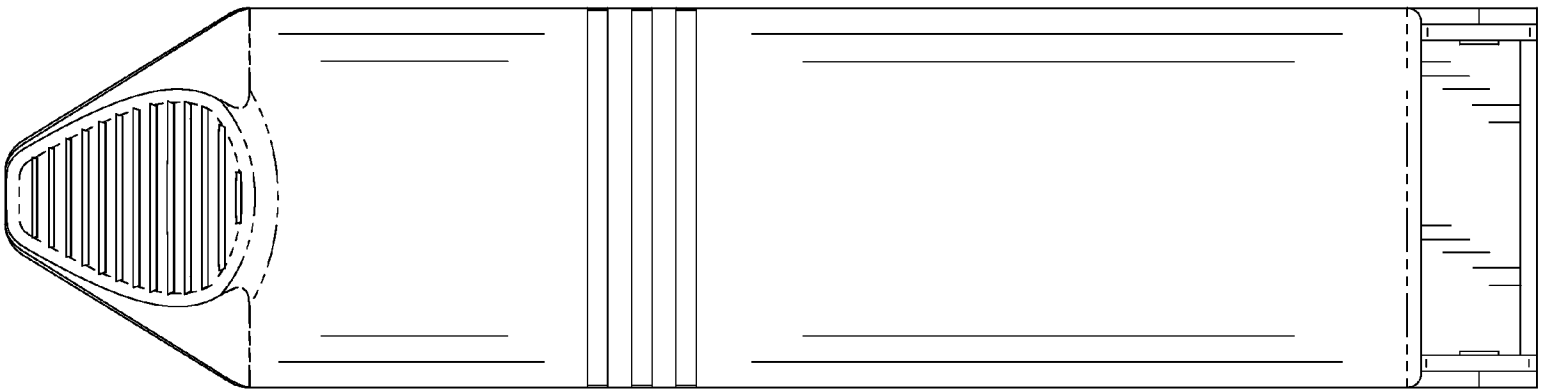
FIG. 7 is a top plan view of the present invention in a closed position.

All illustrations of the drawings are for the purpose of describing selected versions of the present invention and are not intended to limit the scope of the present invention.

The present invention provides the user with the ability to dislodge and uproot hairs, dirt, lint, or any other debris from clothing, car interiors, or any other suitable surfaces. The uprooted debris from the dirty surfaces are pulled to the surface to be picked up and retained for disposal. In reference to FIG. 8, to provide the user with such this ability, the present invention comprises a roller base 1, a roller cover 2, a roller 3, a rubber brush 5. The roller base 1 is the main body of the present invention that connects all of the components together. The roller 3 is a cylindrically shaped component that is responsible for picking up lint, hairs, and other debris from a soiled surface. The roller base 1 provides the roller 3 with the ability to freely rotate while still being secured, ensuring the user with complete control over the present invention. The purpose of the rubber brush 5 is to dislodge and uproot any hairs, lint, or debris caught within the fibers of a fabric to the surface. Once the rubber brush 5 has uprooted the lint, hair, and debris from the clothing, the user rolls the roller 3 over the soiled surfaces to completely remove the lint or hair.

In reference to FIGS. 1-5 and FIG. 8-10, the roller base 1 is the main component of the present invention that comprises a base hinge end 10, a pair of roller mount plates 11, a base hinge 12, outer base walls 13, and a brush surface 14. The base hinge 12 is positioned on the base hinge end 10 of the roller base 1. The outer base walls 13 are peripherally positioned and protrude from the roller base 1. The outer base walls 13 only protrude from one side of the roller base 1 to leave a flat surface on the opposite side. A roller base cavity 131 is defined by the outer base walls 13, and provides a recessed space for the roller 3 to be held in. The pair of roller mount plates 11 is parallel plates that serve to secure the roller 3 to the roller base 1. The pair of roller mount plates 11 is extended from the roller base 1 within the roller base cavity 131 in parallel relationship to each other. The distance between each of the roller mount plates 11 is consistent to the length. However, the distance may be slightly larger than the length of the roller 3 to ensure the roller 3 has enough room in the roller base 1 to rotate. Additionally, the pair of roller mount plates 11 is extends slightly beyond and past the outer base walls 13. It is important that the pair of roller 3 mount plate possesses enough structural stability to ensure the roller 3 is securely held within the roller base cavity 131. The brush surface 14 is an open face on the roller base 1 positioned opposite to the roller base cavity 131. The brush surface 14 further comprise of an angled surface 141. The angled surface 141 provided by the brush surface 14 is curved away from the brush surface 14 and allows the present invention to reach any smaller spaces or areas of any surface for more effective lint removal.

Figure 8:
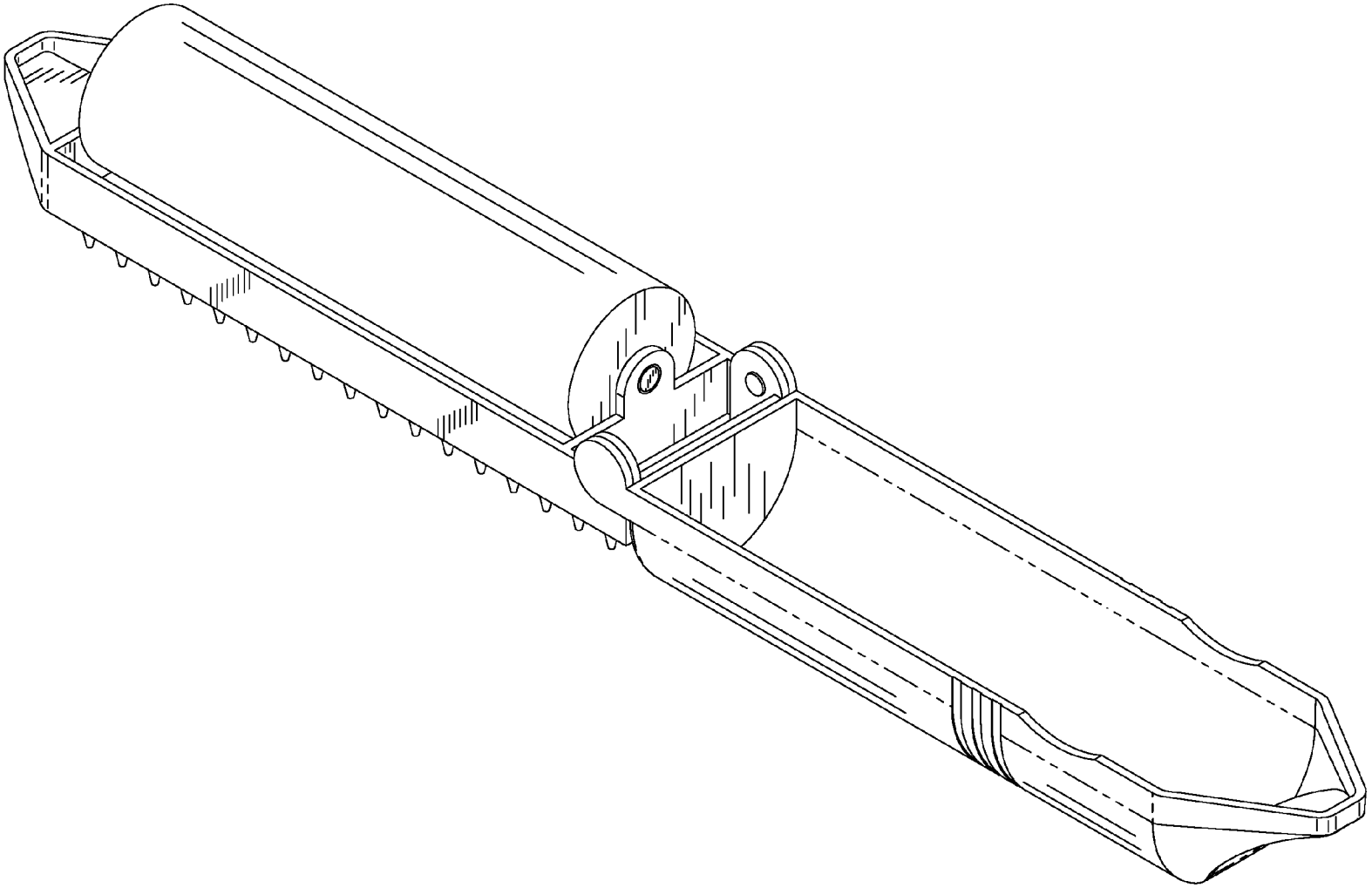
FIG. 8 is a perspective view of the present invention in an open position exposing the roller.
Figure 9:
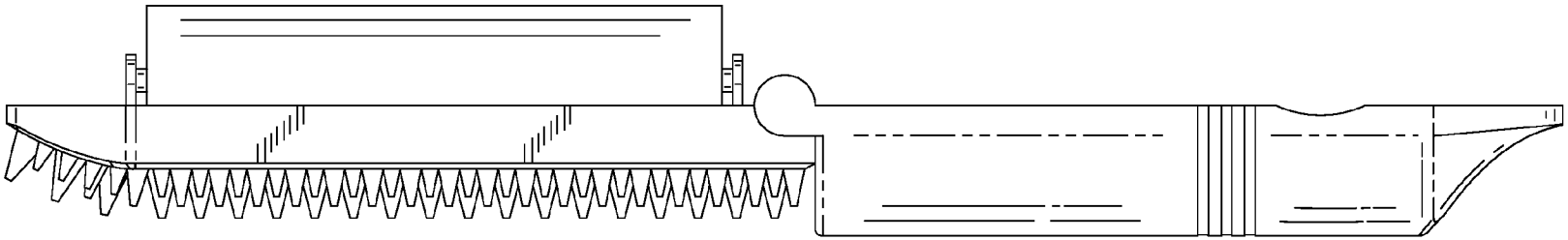
FIG. 9 is a right side elevational view of the present invention in an open position.
Figure 10:
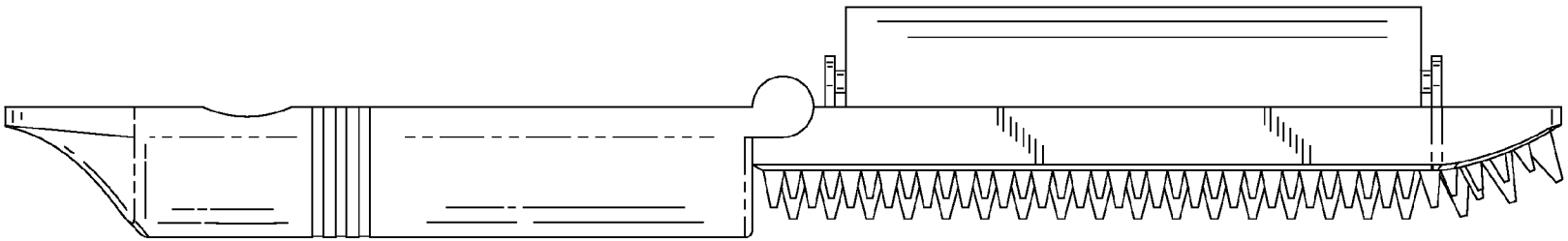
FIG. 10 is a left side elevational view of the present invention in an open position.
Figure 12:
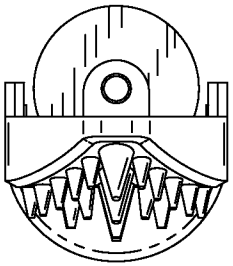
FIG. 12 is a front elevational view of the present invention in an open position.
Figure 11:
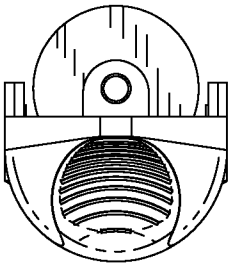
FIG. 11 is a rear elevational view of the present invention in an open position.

In reference to FIG. 8-10, the roller cover 2 is the component of the present invention that is able to enclose and protect the roller 3 when not in use. The roller cover 2 comprises a cover hinge end 20, a roller cover cavity 21, a cover grip 22, an opening indent 23, and a cover hinge 24. The cover hinge 24 is positioned on the cover hinge end 20 of the roller cover 2. The roller cover 2 is a shell-like component shaped correspondingly to the roller base 1. The roller cover cavity 21 is a recessed space on the roller cover 2 that will contain the roller 3 when connected with the roller base 1. The roller cover 2 is semi-cylindrically shaped with the end of the roller cover 2 opposite of the cover hinge end 20 being concavely curved to a rounded point. The cover grip 22 is positioned on the outer surface of the roller cover 2 opposite to the cover hinge 24 within the concave curve. The cover grip 22 provides the user with an indentation in which the user is able to pull on to lift the roller cover 2 off of the roller base 1. The opening indent 23*s* are indentations positioned on opposing edges of the roller cover 2. The opening indents 23 provide the roller cover 2 with an alternative method to lift the roller cover 2 off of the roller base 1.

In reference to FIG. 8-10, the roller 3 is the component of the present invention responsible for picking up and retaining hairs, lint, and other debris from a soiled surface. The roller 3 comprises of a core 31, a sticky layer 32, and a pair of pins 32. The core 31 is cylindrically shaped and provides the roller 3 the ability to roll. The core 31 is sized to have a radius and length to fit into the roller base cavity 131 and the roller cover cavity 21 of the roller base 1 and the roller cover 2. The core 31 can be made from any materials including plastics, metals, woods or any other suitable materials. In the preferred embodiment of the present invention, the core 31 is made from a plastic material. The sticky layer 32 is the component of the roller 3 that is able to pick up and retain hair, lint, and other debris. The sticky layer 32 is adhered to the circumferential area of the core 31. In the preferred embodiment of the present invention, the sticky layer 32 is made out of the material silicone rubber. Silicone rubber is a material with a very low glass transition temperature. The property of low glass transition temperature provides the silicone rubber with the ability to attract and remove foreign particles. The glass transition temperature is temperature that determines the phase transition that separates a material's two different states of matter. The silicone rubber's property of a low glass transition temperature provide it with a unique cross-linking polymer structure and is the reason that it is able to attract and retain pet hairs, dirt, and dust. The unique cross-linking structure of the silicone rubber also provides it a sticky layer 32 on its surface. Although silicone is the material of the preferred embodiment of the present invention, the material for the sticky layer 32 can be any other suitable materials that provide adhesive capabilities for attracting and retaining hair, lint, and debris. However, the material must be washable to restore stickiness. To secure the roller 3 to the roller base 1, the pair of pins 32 is positioned on and protrudes from the two ends of the core 31 in a concentric relationship. The pair of pins 32 is shaped and sized to adapter holes that are positioned on the pair of roller mount plates 11 on the roller base 1. This ensures that the roller 3 is able to rotate smoothly while still being secured to the roller base 1.

Figure 13:
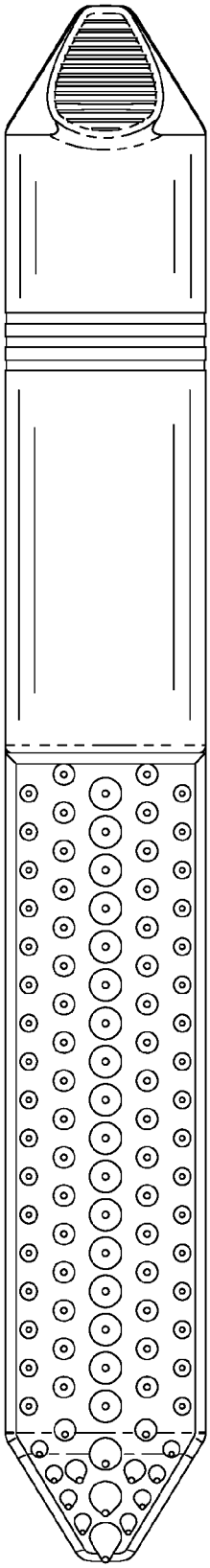
FIG. 13 is a bottom plan view of the present invention in an open position.
Figure 14:
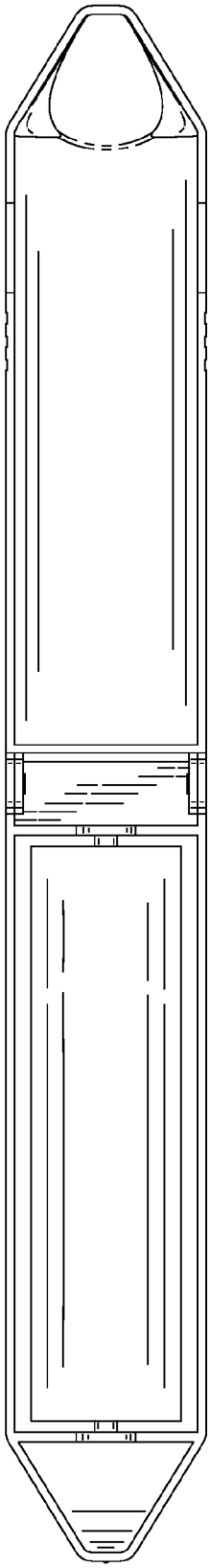
FIG. 14 is a top plan view of the present invention in an open position.

In reference to FIGS. 9-10 and FIG. 13, the rubber brush 5 is the component of the present invention that is responsible for dislodging and pulling hairs, lint, and debris that are intertwined with the fibers of a fabric surface. The rubber brush 5 comprises of a finger side 51, a bracket side, and a plurality of finger members. In the preferred embodiment of the present invention, the rubber brush 5 is made from the material thermoplastic rubber. Similar to the sticky layer 32 of the roller 3, the thermoplastic rubber will help the rubber brush 5 attract and pull dust from the a soiled material. However, in other embodiments of the present invention, the rubber brush 5 can be made from any rubber materials capable of dislodging and removing hair, lint, and debris particles from a user's clothes. The rubber brush 5 is a piece of thermoplastic rubber that is shaped consistently with the brush surface 14. The bracket side is the side of the rubber brush 5 that is adhered directly to the brush surface 14. In the preferred embodiment of the present invention, the brush surface 14 is curved in a convex fashion to provide added stability and strength to the rubber brush 5. The finger side 51 is the side of the rubber brush 5 where the plurality of fingers 53 protrudes from. The plurality of fingers 53 is protruding tips that can be any shape including rounded cones, rounded hooks, tetrahedrons, or any other shape capable of effectively dislodging and pulling hairs, lint, and other debris from soiled surfaces. The plurality of fingers 53 protruding from the finger side 51 of the rubber brush 5 can be patterned in any way that can efficiently pull the maximum amount of pet hair, dirt, and debris from the carpet or upholstery layers. The plurality of fingers 53 can be patterned in a linear array fashion or a staggered fashion with different finger members varying in shapes and sizes. For example, the plurality of finger can be arranged in a linear array fashion with alternating rows of short tetrahedron and long rounded cones.

In reference to FIG. 8, the apparatus of the present invention is assembled by the connection of the roller cover 2 to the roller base 1. The roller cover 2 is jointly connected to the roller base 1 by means of the cover hinge 24 and the base hinge 12. The cover hinge 24 is jointly engaged to the base hinge 12 and provides the roller cover 2 to pivot on the roller base 1. The hinge type connection between the roller cover 2 and the roller base 1 allows the user to cover and uncover the roller 3 secured within the roller base cavity 131. The roller 3 is engaged to the roller base 1 by means of the pair of pins 32. The roller 3 is positioned within and protruding from the roller base cavity 131. The pair of roller mount plates 11 is slightly protruded past the outer base walls 13 to allow the roller 3 to protrude from the roller base cavity 131. This allows the roller 3 to make contact with the soiled surface of clothing or any other soiled surface when being used. The pair of pins 32 is jointly engaged to adapter holes that are positioned on each of the roller mount plates 11. The rubber brush 5 is adhered to the roller base 1 on the brush surface 14 by means of the base side 52. The base side 52 is adhered to the brush surface 14 and the angled surface 141 by means of the brush adhesive 4. With the roller base 1 being shaped to a rounded point on the end opposite of the base hinge end 10, the rubber brush 5 is shaped correspondingly to completely cover the brush surface 14 and the angled surface 141.

The default position of the present invention is when the roller cover 2 is in a closed position engaged to the roller base 1 while covering the roller 3. With the roller cover 2 enclosing the roller 3, the roller cover 2 and the roller base 1 together are conveniently shaped for easy maneuvering and handling by the user. With easy handling, the user is able to take the rubber brush 5 and press it up against the surface of an article of clothing or any other soiled surface. With a sweeping motion across the soiled surface, the plurality of fingers 53 is able to pull and remove any intertwined hairs, lint, or debris from the fibers of the fabric. Once all of the hairs, lint, and debris have been uprooted and pulled to the surface, the used is able to lift the roller cover 2 off of the roller base 1 by means of the cover grip 22*s* or the opening indents 23. The roller cover 2 is pivoted about the base hinge 12 by means of the cover hinge 24 to expose the roller 3. The user is then able to flip the present invention around to apply the roller 3 to the soiled surface. While rolling the roller 3 over the soiled surface, the roller 3 will pick up and retain any hairs, lint, or debris. During the process of cleaning, hair, lint, and debris will collect and accumulate on the rubber brush 5 and the roller 3. The accumulated debris will slowly decrease the ability of the rubber brush 5 and the sticky layer 32 of the roller 3 from attracting and retaining additional hairs, lint, and debris. The user will have to wash the present invention with water. Water is able to release pet hairs, dirt, and debris from the rubber brush 5 and the sticky layer 32. With a clean rubber brush 5 and sticky layer 32, the user is able to resume the cleaning process. Once cleaned, the user is able to return the roller cover 2 into a closed position to enclose and protect the roller 3 from unnecessarily picking up dirt. The function of enclosing the roller 3 provides the present invention with portability.

Although the invention has been explained in relation to its preferred embodiment, it is to be understood that many other possible modifications and variations can be made without departing from the spirit and scope of the invention as hereinafter claimed.

What is claimed is:

1. A portable hair/lint roller comprising:

a base portion comprising a base member including a top surface and a bottom surface, a plurality of outer base walls protruding upward from the top surface, and a roller base cavity defined by the top surface and the plurality of outer base walls;

a brush including a brush surface disposed on the bottom surface of the base member and a plurality of finger members, the plurality of finger members protruding downward from the brush surface;

a sticky roller rotatably attached to the base portion and disposed within the roller base cavity; and a cover portion hingedly attached to the base portion and configured to cover the sticky roller when the cover is in a closed position, wherein when the cover portion is in the closed position, the cover portion is disposed directly above the brush surface.

2. The portable hair/lint roller of claim 1, wherein the brush is configured to dislodge debris from a fabric surface, and the sticky roller has an outer surface configured to retain the debris.

3. The portable hair/lint roller of claim 1, wherein the sticky roller comprises a core having an outer circumferential surface and a sticky layer adhered to the outer circumferential surface of the core.

4. The portable hair/lint roller of claim 3, wherein the sticky roller comprises silicone rubber configured to release debris retained thereon by washing with water.

5. The portable hair/lint roller of claim 1, wherein the finger members of the brush are comprised of a thermoplastic rubber.

* * * * *